US011965706B2

(12) United States Patent
Hillis et al.

(10) Patent No.: US 11,965,706 B2
(45) Date of Patent: Apr. 23, 2024

(54) COMPOSITE CHARGING HANDLE

(71) Applicant: DFM Arms, LLC, Sheridan, WY (US)

(72) Inventors: Mark Hillis, West Valley City, UT (US); Nathan Dudney, Nashville, TN (US); Evan Dungan, Christiana, TN (US); Joel Stanley, Smyrna, TN (US)

(73) Assignee: DFM Arms, LLC, Sheridan, WY (US)

( * ) Notice: Subject to any disclaimer, the term of this patent is extended or adjusted under 35 U.S.C. 154(b) by 0 days.

(21) Appl. No.: 17/847,726

(22) Filed: Jun. 23, 2022

(65) Prior Publication Data

US 2022/0412680 A1 Dec. 29, 2022

Related U.S. Application Data

(60) Provisional application No. 63/215,323, filed on Jun. 25, 2021.

(51) Int. Cl.
*F41A 3/72* (2006.01)

(52) U.S. Cl.
CPC ..... *F41A 3/72* (2013.01)

(58) Field of Classification Search
CPC ..... F41A 3/72
USPC ..... 89/1.4
See application file for complete search history.

(56) References Cited

U.S. PATENT DOCUMENTS 10,161,697 B1 * 12/2018 Underwood ..... F41A 3/72

* cited by examiner

*Primary Examiner* — Reginald S Tillman, Jr.
(74) *Attorney, Agent, or Firm* — J. Kenneth Hoffmeister

(57) ABSTRACT

A composite charging handle assembly.

18 Claims, 5 Drawing Sheets

View B-B

View C-C

View D-D

COMPOSITE CHARGING HANDLE

CROSS REFERENCE

The present Application for Patent claims the benefit of U.S. Provisional Application No. 63/215,323, filed Jun. 25, 2021, and is expressly incorporated by reference in its entirety herein.

TECHNICAL FIELD

The present disclosure relates generally to charging handles. More particularly, the disclosure relates to a composite charging handle with improved mechanical and performance properties that is manufactured at a reduced cost.

BACKGROUND

A firearm charging handle is used to manually cycle the action of the firearm by retracting the carrier bolt group to allow a bullet into the chamber. Traditionally, charging handle bodies are machined or cast from aluminum. However, such manufacturing techniques fails to take advantage of modern materials and techniques. Therefore a need exists for a charging handle that combines new materials, such as stainless steel, polymers and carbon fiber where it is best suited. A need further exists to provide a charging handle that is a reduced weight. A further need exists for a charging handle manufactured with alternative manufacturing techniques. A further need exists for a charging handle that utilizes materials to provide improved performance in both the charging handles action in the receiver and with the user's manipulation of the charging handle. A need exists for a charging handle that utilizes modern materials and techniques in the manufacture to meet or exceed the strength needs of the mechanism while improving consistency of manufacturing dimensions and processes and decreasing production time and effort. Thus an apparatus is needed to improve charging handles.

BRIEF SUMMARY

The general purpose of the apparatus and methods disclosed herein is to provide an improved charging handle that allows for the improved performance of charging handle function and manufacture.

The charging handle shaft would have one or more durable metal pieces that are held in a mold in an injection molding machine and then overmolded with a durable polymer, the polymer comprising the exterior surface that will contact the rest of the firearm. This will permanently bond them together with the resulting combination having extremely consistent dimensions while maintaining the requisite strength and durability for the application. In the instance that two of more metal pieces are used, the second plate adds rigidity and strength for the shaft component as well as for the pins securing the charging handles/latches.

The charging handles/latches are comprised of two pieces, with the portion that interfaces with the charging handle body being made from a durable metal and the portion that the user touches being made of a polymer or other durable material such as aluminum or steel, in a separate operation. The two pieces are then mechanically attached to prevent easy separation in use, yet facilitate interchangeability in the future.

Specifically, a system of one or more composite materials can be configured to perform particular operations or actions by mechanically engaging a bolt carrier group that in operation causes or cause the firearm to perform the actions. One or more mechanical members programs can be configured to perform particular operations or actions by virtue of including structures that, when manipulated, cause the apparatus to perform the actions. One general aspect includes a composite charging handle assembly. The composite also includes a primary component which may include a body as an integrated structure made from a first material and extending a first axial direction from a head portion at the first end to a second end, where the primary component further may include a first lateral side and a second lateral side extending along the axial length of the body from the second end and terminating at the start of the head portion, a top side, and a bottom side opposite the top side; where the primary component further may include a member extending from the second end; where the head portion may include a substantially planar stamped portion; where the perimeter of the head portion is scalloped; where the head portion may include a first pivot hole formed in a first rounded protuberance and a second pivot hole formed in a second rounded protuberance; where the first and second lateral sides are distally coined to distally extend the distance between the lateral sides; where a plurality of plastic connecting holes are formed in the primary component; where the head portion may include a plurality of plastic connecting holes. The composite also includes a secondary component which substantially covers the primary head portion at the first end, the second end, the first lateral side, the second lateral side the top side, and the bottom side opposite the top side where the secondary component is made from a second material, where the secondary component is a skin over the first component, where the secondary component may include a bilateral receiving slot formed in the head portion covering, where the receiving slot is below a primary plane formed by the top side of the primary member, where the secondary component may include a mating cup extending continuously above the primary plane formed by the top side of the primary member, where the secondary component may include a first rib fixed to the distal side of the first lateral side and a second rib fixed to the distal side of the second lateral side. The composite also includes a primary latch member mated into the receiving slot where the primary latch member may include a latch extending along the first axial direction and terminating in a hook, where the primary latch may include a hinge lever coupled to the head portion by a first hinge pin at the primary member first or second pivot hole, where the primary latch may include a first stamped tab extending distally from the head portion, where the primary latch member may include a first insert, where the first stamped tab extends from the first hinge pin. The composite also includes a secondary latch activator mated into the receiving slot and articulated to the primary latch member where the activation of the secondary latch manipulates the hook; where the secondary latch activator is coupled to the head portion by a second pin at the first or second pivot hole, where the secondary latch activator may include a second stamped tab extending distally from head portion, where the second stamped tab extends from the second hinge pin. The composite also includes a backing plate may include insert pilots, and plate connecting holes, where the insert pivot holes align with the primary component pivot holes. The composite also includes a first stamped tab cover fixed to the primary latch member tab and a second stamped tab cover fixed to the second stamped tab; where the first stamped tab cover or the second stamped tab cover is configured to selectively reconfigured without being separated from the tab to which it is fixed. where the stamp cover is configured to screwedly reconfigure and distally extend to lengthen the functional length of the stamped tab, where the stamp cover is configured unfold to increase the functional surface area of the stamp cover where the stamp cover is adhesively fixed to the stamped tab, where the stamp cover is mechanically fixed to the stamped tab with a pin, where the stamp cover is slid over the stamped tab. Other embodiments of this aspect include corresponding structures and apparatus, each configured to perform the actions of the methods.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed descriptions of the embodiments of the apparatus, as represented in FIGS. 1 through 6 are not intended to limit the scope of the invention, as claimed, but are merely representative of present embodiments of the invention.

In general, the figures disclose an invention that provides a composite charging handle configured to improve the performance and function of the charging handle. In some embodiments comprise a metal core with an overmolded polymer for a permanent bond. In some embodiments the metal core could be comprised of one or more parts and could be made of a number of different metal alloys.

In some embodiments the charging handles/latches are each comprised of two or more separate pieces that are not permanently bonded or attached. In some embodiments the first piece is made of metal and is attached to the body of the charging handle by common fastening methods. In some embodiments a second piece would be polymer or other durable material such as aluminum or steel and would be mechanically attached by pins, screws or other common fastening method and would offer interchangeability or user serviceability.

In some embodiments the charging handle shaft may have a stainless steel core for strength and corrosion resistance. In some embodiments the core may be stamped. In some embodiments the polymer used for the overmolding would have high temperature resistance, low friction, good UV light resistance and high rigidity.

In some embodiments the charging handles/latches would ideally have a stainless steel plate for corrosion resistance and strength. In some embodiments if made from polymer, the handles would have high rigidity, high strength and good UV light resistance. In some embodiments if made from aluminum or steel, the handles would have high rigidity, high strength and excellent corrosion resistance.

In the following description, references will be made to firearms, bullets, bolt carrier groups and receivers, but these items are not shown in detail in the figures. However, it should be understood that one of ordinary skill in the art and in possession of this disclosure, would readily understand how the present invention and firearms and firearm components can be incorporated.

Figure 1A:
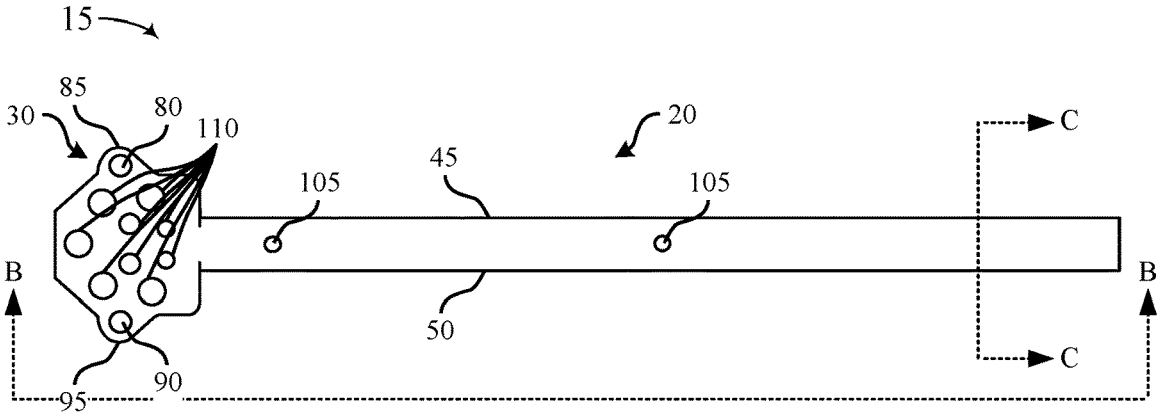
FIG. 1A shows a top view of the primary component.
Figure 1B:
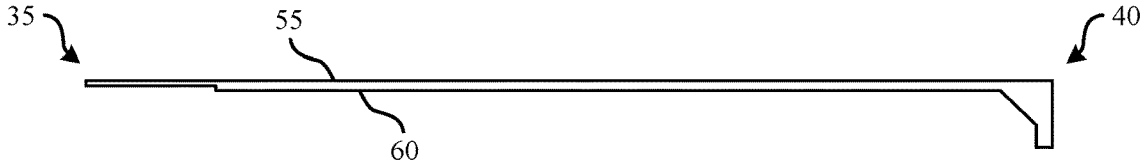
FIG. 1B shows a profile view of the primary component.
Figure 1C:
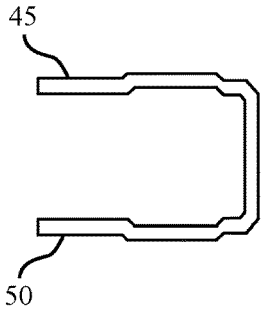
FIG. 1C shows a cross-sectional view of the primary component.
Figure 1D:
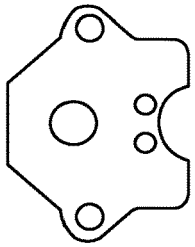
FIG. 1D shows a top view of the backing plate.
Figure 2A:
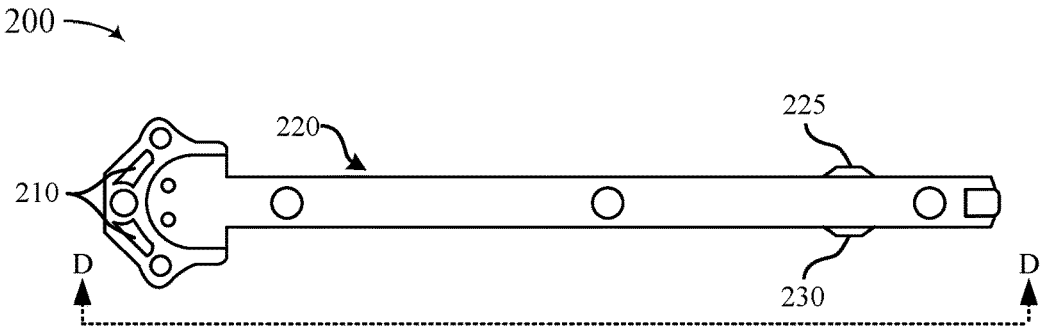
FIG. 2A shows a top view of the secondary component.
Figure 2B:
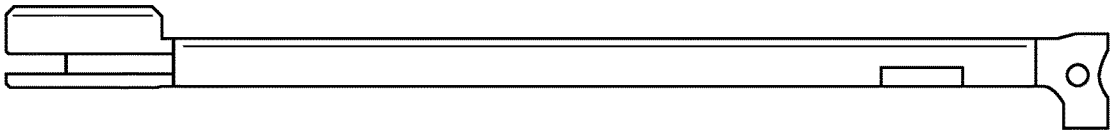
FIG. 2B shows a side view of the secondary component.
Figure 2C:
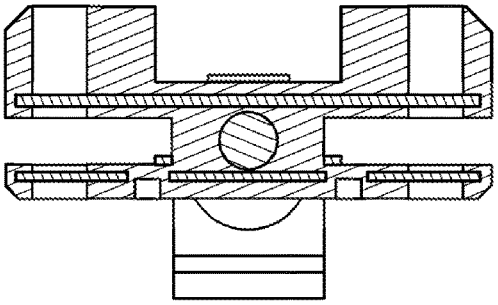
FIG. 2C shows an end view of the head portion primary, secondary and backing plate components combined.
Figure 2D:
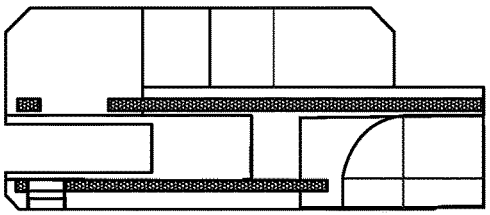
FIG. 2D shows a side view of the head portion primary, secondary and backing plate components combined.
Figure 2E:
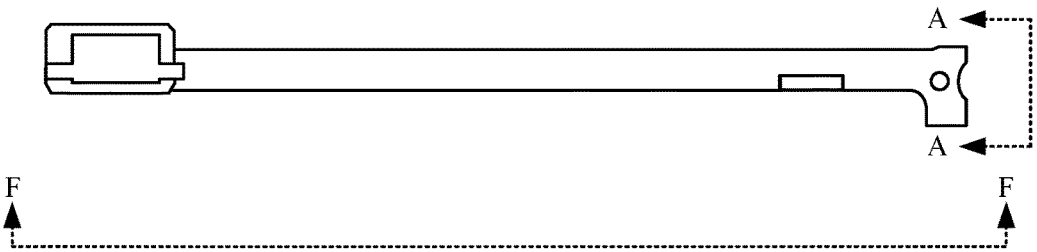
FIG. 2E shows primary, secondary and backing plate components combined.
Figure 3A:
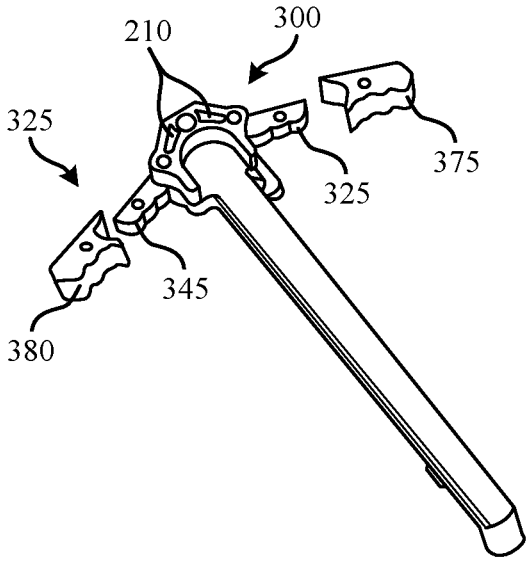
FIG. 3A shows an exploded view of the composite charging handle.
Figure 3B:
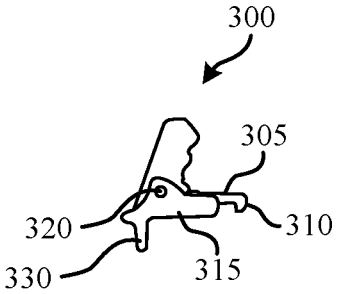
FIG. 3B shows a detailed view of the primary latch member.
Figure 3C:
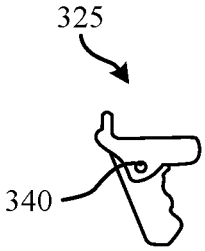
FIG. 3C shows a detailed view of the secondary latch activator.
Figure 3D:
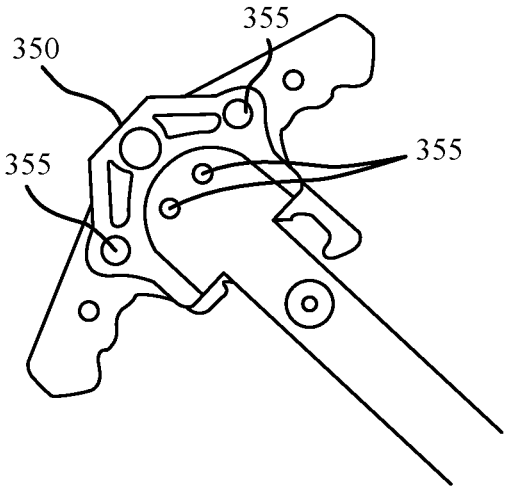
FIG. 3D shows a partial view of the composite charging handle assembly.
Figure 3E:
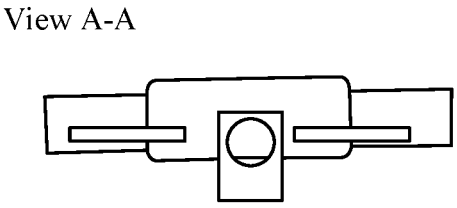
FIG. 3E shows an end view of the composite charging handle.
Figure 3F:
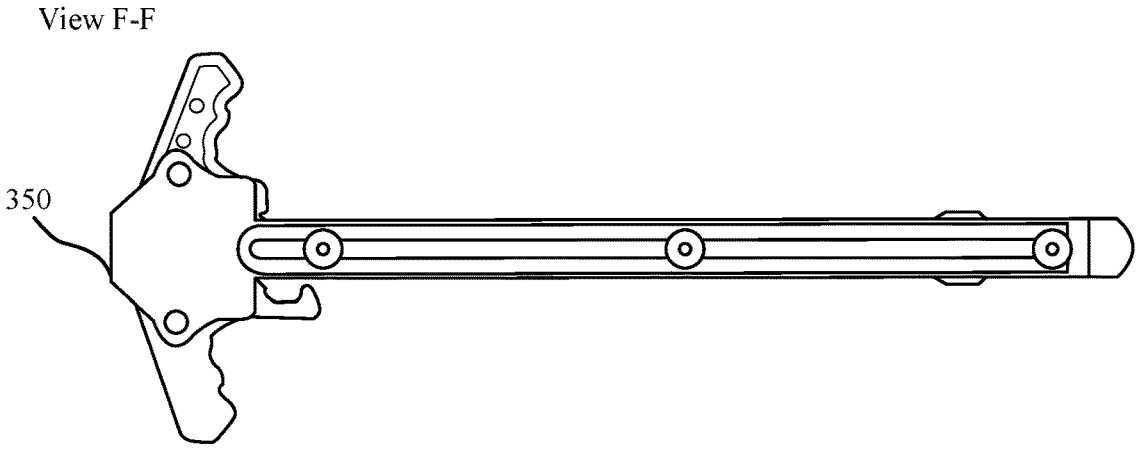
FIG. 3F shows an alternative plan view of the composite charging handle assembly.
Figure 4:
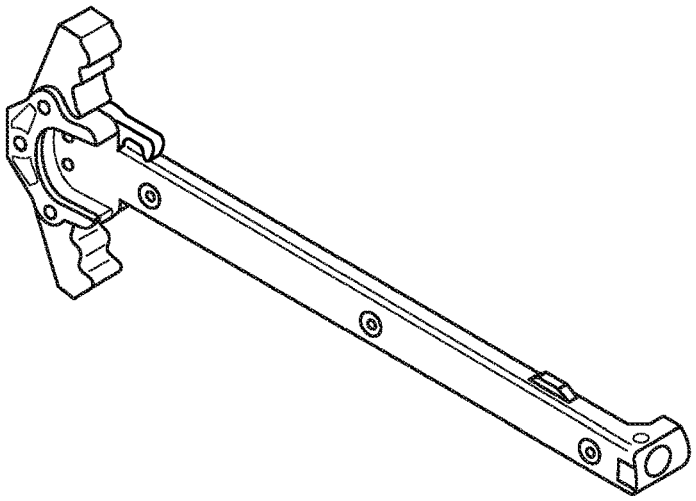
FIG. 4 shows a perspective view of the composite charging handle assembly.
Figure 5:
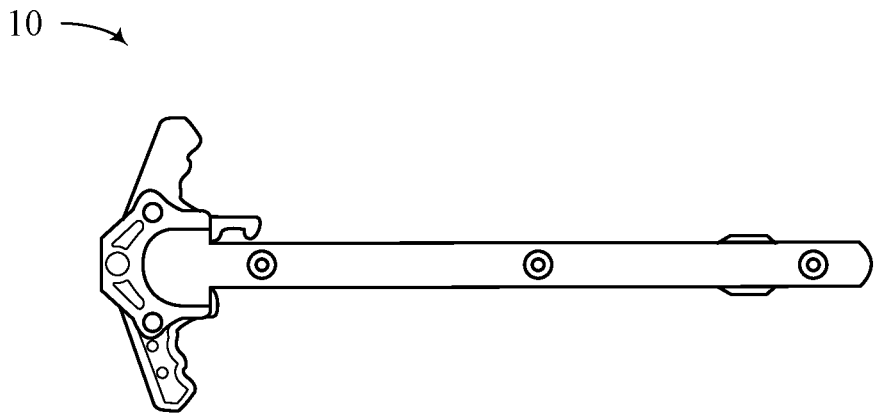
FIG. 5 shows a top view of the composite charging handle assembly.
Figure 6:
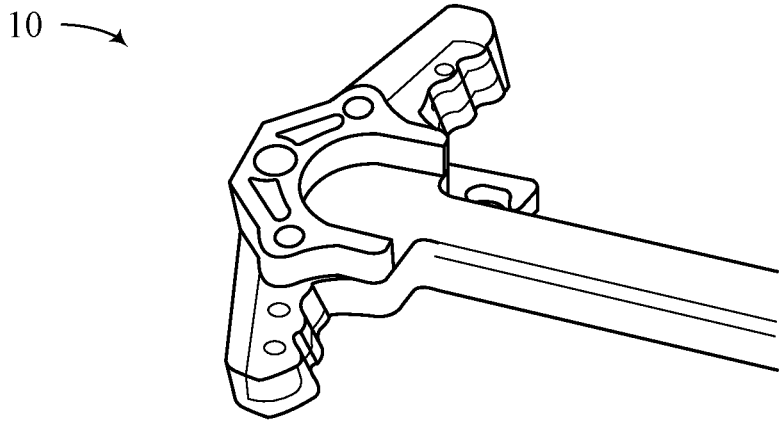
FIG. 6 shows a transparent view of the charging handle assembly.

Detailed references will now be made to the preferred embodiments of the present invention, examples of which are illustrated in FIGS. 1A through 1D, which depict a primary component 15 comprising a body 20 as an integrated structure made from a first material (e.g., 310 stainless steel, or 310 ss) and extending a first axial direction from a head portion 30 at the first end 35 to a second end 40. In some embodiments the primary component 15 further comprises a first lateral side 45 and a second lateral side 50 extending along the axial length of the body from the second end and terminating at the start of the head portion 30, a top side 55, and a bottom side 60 opposite the top side 55. In some embodiments the primary component 15 further comprises a member 65 extending from the second end 40 (as illustrated in FIG. 1B). In some embodiments the head portion 30 comprises a substantially planar stamped portion. In some embodiments the perimeter of the head portion 30 is scalloped. In some embodiments the head portion 30 comprises a first pivot hole 80 formed in a first rounded protuberance 85 and a second pivot hole 90 formed in a second rounded protuberance 95. In some embodiments the first and second lateral sides 45, 50 are distally coined to distally extend the distance between the lateral sides (as illustrated in FIG. 1C). In some embodiments a plurality of plastic tooling holes 105 are formed in the primary component 15. In some embodiments the head portion 30 comprises a plurality of plastic connecting holes 110.

Referring now to FIGS. 2A through 2E, in some embodiments a secondary component 200 which substantially covers the primary head portion 30 at the first end 35, the second end 40, the first lateral side 45, the second lateral side 50, the top side 55, and the bottom side 60 opposite the top side 55. In some embodiments the secondary component 200 is made from a second material. In some embodiments the secondary component 200 is a skin over the first component 100. In some embodiments the secondary component 200 comprises a bilateral receiving slot 210 formed in the head portion covering. In some embodiments the bilateral receiving slot 210 is below a primary plane formed by the top side 55 of the primary member 100. In some embodiments the secondary component 200 comprises a mating cup 220 extending continuously above the primary plane formed by the top side 55 of the primary member 100. In some embodiments the secondary component 200 comprises a first rib 225 fixed to the distal side of the first lateral side 45 and a second rib 230 fixed to the distal side of the second lateral side 50.

Referring now to FIGS. 3A through 3F, in some embodiments a primary latch member 300 is mated into the bilateral receiving slot 210. In some embodiments the primary latch member 300 comprises a latch 305 extending along the first axial direction and terminating in a hook 310. In some embodiments the primary latch member 300 comprises a hinge lever 315 coupled to the head portion 30 by a first hinge pin 320 at the first pivot hole 80 or the second pivot hole 90. In some embodiments the primary latch member 300 comprises a first stamped tab 325 extending distally from the head portion 30. In some embodiments the primary latch member 300 comprises a first insert 330. In some embodiments the first stamped tab extends from the first hinge pin 320.

In some embodiments a secondary latch activator 335 is mated into the bilateral receiving slot 210 and articulated to the primary latch member 300. In some embodiments the activation of the secondary latch 335 manipulates the hook 310. In some embodiments the secondary latch activator 335 is coupled to the head portion 30 by a second hinge pin 340 at the first pivot hole 80 or the second pivot hole 90. In some embodiments the secondary latch activator 335 comprises a second stamped tab 345 extending distally from the head portion 30. In some embodiments the second stamped tab 345 extends from the second hinge pin 340.

Some embodiments comprise a backing plate 350 comprising insert pilots 355, plate connecting holes 360. In some embodiments the insert pivot holes align with the pivot holes 85, 90 of the primary component.

In some embodiments the top stamping and bottom/back stamping are both encased in the composite. In some embodiments the xy plane cross section of the charging handle show both the larger stamping on top and the bottom/back plate. In some embodiments both the top and bottom/back plate are both encased in the composite.

In some embodiments the backing plate 350 will be completely covered with polymer in the final product. It will sit close to the bottom surface and the polymer will flow around it. The polymer will flex as the dovetail portion of the mold is retracted and keep the original shape, while the backing plate 350 provides rigidity to the polymer.

In some embodiments the composite charging handle comprises a first stamped tab cover 375 fixed to the first stamped tab 325 and a second stamped tab cover 380 fixed to the second stamped tab 345. In some embodiments the first stamped tab cover 375 and/or the second stamped tab cover 380 is configured to be selectively reconfigured without being separated from the tab to which it is fixed. In some embodiments the first stamped cover 375 and/or the second stamped cover 380 is configured to be screwedly reconfigured and distally extend to lengthen the functional length of the stamped tab. In some embodiments the first stamped cover 375 and/or the second stamped cover 380 is configured unfold to increase the functional surface area of the stamp cover. In some embodiments the first stamped cover 375 and/or the second stamped cover 380 is adhesively fixed to the first stamped tab 325 and/or the second stamped tab 345, respectively. In some embodiments the first stamped cover 375 and/or the second stamped cover 380 is mechanically fixed to the first stamped tab 325 and/or the second stamped tab 345, respectively, with a pin 390. The mechanically attached stamp covers, whether polymer or other durable materials, allow for user configurability without disassembling the functional parts of the charging handle. In some embodiments the first stamped cover 375 and/or the second stamped cover 380 is slid over the first stamped tab 325 and/or the second stamped tab 345, respectively.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A composite charging handle assembly, comprising:

a primary component wherein:

a head portion of the primary component comprises a substantially planar stamped portion, a first pivot hole formed in a first rounded protuberance of the head portion, a second pivot hole formed in a second rounded protuberance of the head portion, and a plurality of plastic connecting holes, wherein a perimeter of the head portion of the primary component is scalloped, and wherein the head portion of the primary component is at a first end;

a body of the primary component is an integrated structure made from a first material and extends from the head portion of the primary component in a first axial direction from the first end to a second end;

a first lateral side of the primary component and a second lateral side of the primary component extend from the head portion of the primary component in the first axial direction, wherein the first lateral side of the primary component and the second lateral side of the primary component are distally coined to distally extend a distance between the first lateral side of the primary component and the second lateral side of the primary component; and a member of the primary component extends from the second end; and a secondary component that substantially covers the head portion of the primary component and the body of the primary component, wherein:

the secondary component is made from a second material and is a skin over the primary component, a portion of the secondary component covering the head portion of the primary component comprises a bilateral receiving slot that is below a primary plane formed by a top side of the primary component, a mating cup of the secondary component extends continuously above the primary plane formed by the top side of the primary component, a first rib of the secondary component is fixed to a distal side of the first lateral side of the primary component, and a second rib of the secondary component is fixed to a distal side of the second lateral side of the primary component.

2. The composite charging handle assembly of claim 1, further comprising:

a primary latch member mated into the bilateral receiving slot of the secondary component, wherein:

a latch of the primary latch member extends along the first axial direction and terminates in a hook of the primary latch member, a hinge lever of the primary latch member is coupled to the head portion of the primary component by a first hinge pin at the first pivot hole of the primary component or the second pivot hole of the primary component, and a first stamped tab of the primary latch member extends from the first hinge pin and distally from the head portion of the primary component.

3. The composite charging handle assembly of claim 2, further comprising:

a first stamped tab cover fixed to the first stamped tab of the primary latch member.

4. The composite charging handle assembly of claim 3, wherein:

the first stamped tab cover is configured to be selectively reconfigured without being separated from the first stamped tab of the primary latch member.

5. The composite charging handle assembly of claim 3, wherein:

the first stamped tab cover is configured to be screwedly reconfigured and to distally extend a functional length of the first stamped tab of the primary latch member.

6. The composite charging handle assembly of claim 3, wherein:

the first stamped tab cover is configured to unfold to increase a functional surface area of the first stamped tab of the primary latch member.

7. The composite charging handle assembly of claim 3, wherein:

the first stamped tab cover is adhesively fixed to the first stamped tab of the primary latch member.

8. The composite charging handle assembly of claim 3, wherein:

the first stamped tab cover is mechanically fixed to the first stamped tab of the primary latch member.

9. The composite charging handle assembly of claim 3, wherein:

the first stamped tab cover is configured to be slid over the first stamped tab of the primary latch member.

10. The composite charging handle assembly of claim 2, further comprising:

a secondary latch activator mated into the bilateral receiving slot of the secondary component and articulated to the primary latch member, wherein the secondary latch activator is configured to manipulate the hook of the primary latch member by an activation of the secondary latch activator, and wherein the secondary latch activator is coupled to the head portion of the primary component by a second hinge pin at the first pivot hole of the primary component or the second pivot hole of the primary component, wherein:

a second stamped tab of the secondary latch activator extends from the second hinge pin and distally from the head portion of the primary component.

11. The composite charging handle assembly of claim 10, further comprising:

a first stamped tab cover fixed to the first stamped tab of the primary latch member; and a second stamped tab cover fixed to the second stamped tab of the secondary latch activator.

12. The composite charging handle assembly of claim 11, wherein:

the first stamped tab cover is configured to be selectively reconfigured without being separated from the first stamped tab of the primary latch member, and the second stamped tab cover is configured to be selectively reconfigured without being separated from the second stamped tab of the secondary latch activator.

13. The composite charging handle assembly of claim 11, wherein:

the first stamped tab cover is configured to be screwedly reconfigured and to distally extend a functional length of the first stamped tab of the primary latch member, and the second stamped tab cover is configured to be screwedly reconfigured and to distally extend a functional length of the second stamped tab of the secondary latch activator.

14. The composite charging handle assembly of claim 11, wherein:

the first stamped tab cover is configured to unfold to increase a functional surface area of the first stamped tab of the primary latch member, and the second stamped tab cover is configured to unfold to increase a functional surface area of the second stamped tab of the secondary latch activator.

15. The composite charging handle assembly of claim 11, wherein:

the first stamped tab cover is adhesively fixed to the first stamped tab of the primary latch member, and the second stamped tab cover is adhesively fixed to the second stamped tab of the secondary latch activator.

16. The composite charging handle assembly of claim 11, wherein:

the first stamped tab cover is mechanically fixed to the first stamped tab of the primary latch member, and the second stamped tab cover is mechanically fixed to the second stamped tab of the secondary latch activator.

17. The composite charging handle assembly of claim 11, wherein:

the first stamped tab cover is configured to be slid over the first stamped tab of the primary latch member, and the second stamped tab cover is configured to be slid over the second stamped tab of the secondary latch activator.

18. The composite charging handle assembly of claim 1, further comprising:

a backing plate mated into the primary component, the backing plate comprising insert pilots and plate connecting holes, wherein the insert pilots align with the first pivot hole of the primary component and the second pivot hole of the primary component.

* * * * *